US005727936A

United States Patent [19]

Eriksson et al.

[11] Patent Number: 5,727,936

[45] Date of Patent: Mar. 17, 1998

[54] ROTARY DISPLACEMENT COMPRESSOR WITH LIQUID CIRCULATION SYSTEM

[75] Inventors: Leif Eriksson, Shärholmen; Karlis Timuska, Spånga, both of Sweden

[73] Assignee: Svenska Rotor Maskiner AB, Stockholm, Sweden

[21] Appl. No.: 750,482

[22] PCT Filed: Apr. 7, 1995

[86] PCT No.: PCT/SE95/00377

§ 371 Date: Dec. 10, 1996

§ 102(e) Date: Dec. 10, 1996

[87] PCT Pub. No.: WO95/35446

PCT Pub. Date: Dec. 28, 1995

[30] Foreign Application Priority Data

Jun. 21, 1994 [SE] Sweden ..... 9402177

[51] Int. Cl.[6] ..... F04C 18/16; F04C 29/02

[52] U.S. Cl. ..... 418/88; 418/89; 418/97; 418/98; 418/104; 418/DIG. 1; 184/6.16

[58] Field of Search ..... 418/88, 89, 97, 418/98, 104, DIG. 1; 184/6.16

[56] References Cited

U.S. PATENT DOCUMENTS 4,394,113 7/1983 Bammert ..... 418/98

FOREIGN PATENT DOCUMENTS 628340 10/1978 Russian Federation ..... 418/88

2008684 A 6/1979 United Kingdom .

*Primary Examiner*—John J. Vrablik

*Attorney, Agent, or Firm*—Frishauf, Holtz, Goodman, Langer & Chick

[57] ABSTRACT

A rotary displacement compressor having an inlet channel for introducing low pressure gas, an outlet channel through which compressed gas escapes, and at least one rotor mounted in bearings and operating in a working space. The compressor includes a liquid injector for injecting liquid into the working space, a liquid separator provided in the outlet channel for separating liquid from the compressed gas, and a pressure liquid conduit connecting the liquid separator and the liquid injection port. A bearing lubrication circuit includes a tank, a pump, a supply conduit for supplying liquid from the pump to the bearings in which the rotor is mounted, a withdrawal conduit for withdrawing liquid from the bearings to the tank, and a pump inlet conduit for supplying liquid from the tank to the pump. The bearing lubrication circuit further includes a leakage path connecting the tank to a first cavity in the working space and a drainage connection connecting the tank to a second cavity in the working space, the first cavity having a higher pressure than the second cavity.

20 Claims, 1 Drawing Sheet

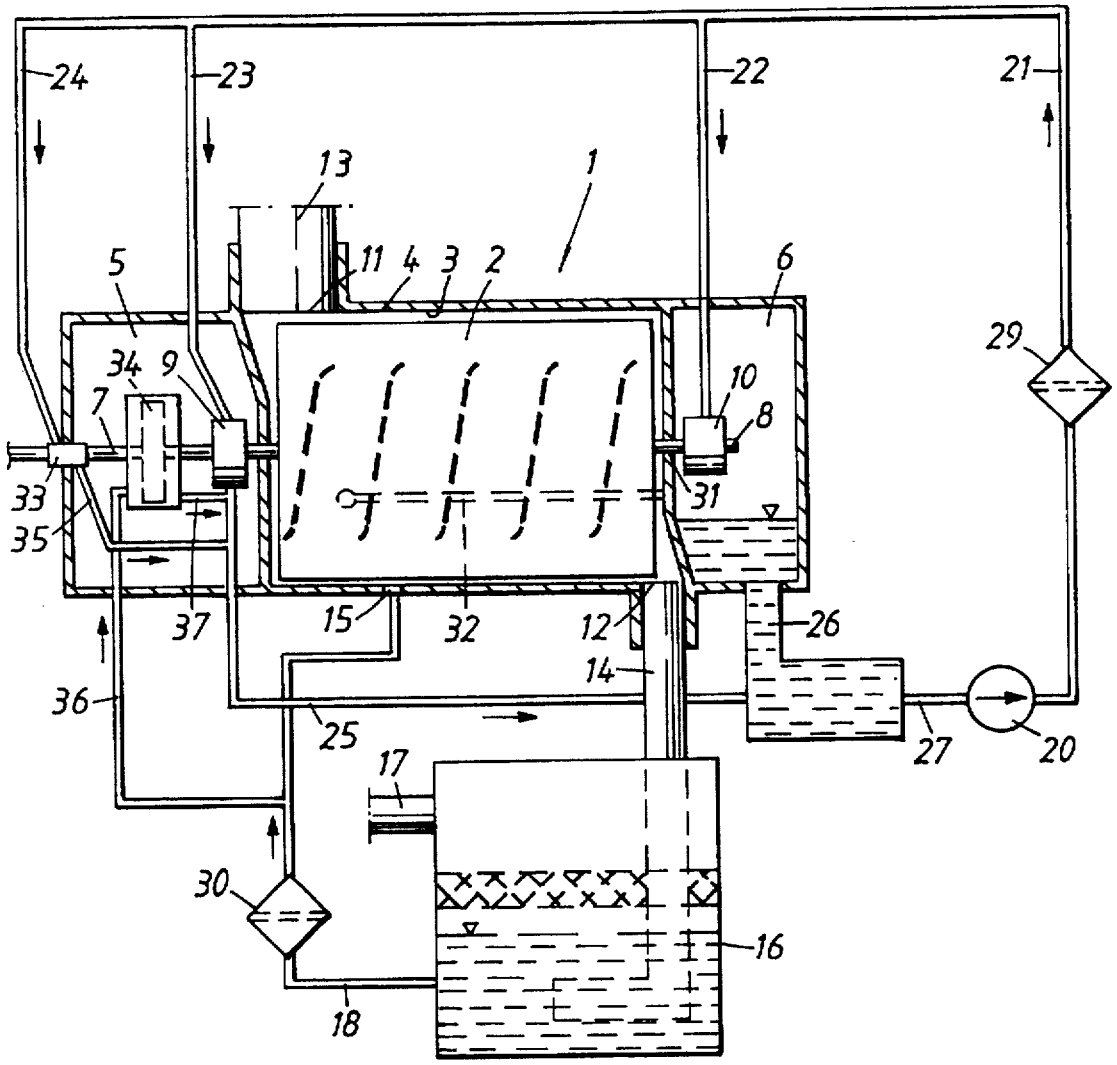
24
23
22
21
13
1
5
11
4
3
2
6
29
34
9
7
10
8
33
31
35
37
15
32
12
26
14
36
25
27
20
17
30
16
18

ROTARY DISPLACEMENT COMPRESSOR WITH LIQUID CIRCULATION SYSTEM

The present invention relates to a rotary displacement compressor having a simple and reliable dual liquid; circulation system.

BACKGROUND OF THE INVENTION

Injection of liquid, usually oil for lubrication, sealing and cooling purposes, into the working space of a compressor of this kind is widely used, in particular in screw compressors. The use of separate circuits for this oil injection and for the bearing lubrication system is advantageous when the compressor operates at high pressures and with a working medium that can dissolve in the oil. The higher the pressure of the oil is, the more the working medium can dissolve in the oil. The working medium dissolved in the oil will decrease the viscosity of the oil and therewith its lubricating ability. The provision of a separate circuit for the bearing lubrication makes it possible to use a lower pressure for the bearing lubrication, than when taking the oil from the oil separator, where compressor outlet pressure prevails. Therethrough the above mentioned problem is avoided. Such systems are earlier known e.g. from GB-A-2 008 684 and U.S. Pat. No. 4,394,113.

GB-A-2 008 684 discloses an oil injected rotary screw compressor in which a portion of the oil in the oil separator is throttled and conducted to a second oil separator at a lower pressure. From this second separator the oil is pumped to the bearings from where it is drained back to the pump. This arrangement requires an extra oil-separator and a recirculation circuit for the working medium in that separator, and therefore becomes somewhat circumstantial.

U.S. Pat. No. 4 394 113 discloses a rotary screw compressor having a main oil circulation circuit including an oil separator and a secondary oil circulation circuit including an oil tank, which secondary circuit operates at a lower pressure and provides lubrication of the bearings. Since oil might leak from one of the circuits to the other, means are provided for maintaining an appropriate amount of oil in the secondary circuit. These means include a conduit connecting the oil separator and the oil tank, which conduit is provided with a solenoid valve controlled by an oil level sensor in the oil tank. This sensor also controls another valve in a conduit through which excess oil in the tank is withdrawn to the compressor inlet. These control equipment makes the compressor complicated.

SUMMARY OF THE INVENTION

The object of the present invention is to attain a rotary displacement compressor having a simple and reliable dual liquid circulation system.

In order to achieve the above object, a rotary displacement compressor according to the present invention has an inlet channel for introducing low pressure gas, an outlet channel through which compressed gas escapes, and at least one rotor mounted in bearings and operating in a working space. The compressor includes a liquid injector for injecting liquid into the working space, a liquid separator provided in the outlet channel for separating liquid from the compressed gas, and a pressure liquid conduit connecting the liquid separator and the liquid injection port. A bearing lubrication circuit includes a tank, a pump, a supply conduit for supplying liquid from the pump to the bearings in which the rotor is mounted, a withdrawal conduit for withdrawing liquid from the bearings to the tank, and a pump inlet conduit for supplying liquid from the tank to the pump. The bearing lubrication circuit further includes a leakage path connecting the tank to a first cavity in the working space and a drainage connection connecting the tank to a second cavity in the working space, the first cavity having a higher pressure than the second cavity.

By connecting the tank through the drainage connection to the working space where a certain intermediate pressure prevails, the oil in the tank will be under that pressure. Through the leakage connection a small amount of oil will leak from the high pressure side of the compressor to the tank to secure a sufficient amount of oil in the bearing lubrication circuit, and through the drainage connection excess of oil in that circuit will be returned to the working space. These connections will thus regulate the system so that an appropriate oil volume will be maintained in the bearing lubrication circuit.

The compressor preferably is a screw compressor. Preferably the first cavity is at compressor end pressure and the second cavity at an intermediate pressure slightly above inlet pressure. In an advantageous embodiment of the invention, the leakage connection is established by the clearance around the high pressure shaft journal of the rotors.

DETAILED DESCRIPTION

The invention will be further explained through the following detailed description of a preferred embodiment thereof and with reference to the accompanying drawing which schematically illustrates a compressor according to the invention.

The compressor 1 in the FIGURE is a rotary screw compressor having a male rotor 2 meshing with a female rotor (not shown) in a working space 3 limited by a barrel section 4, an inlet end section 5 and an outlet end section 6. The male rotor has one shaft journal 7 extending through the low pressure inlet end section 5 for drive connection with an engine. The other shaft journal 8 extends into the outlet end section 6. Each shaft journal is mounted in bearings 9 and 10, respectively. The compressor receives the gas at low pressure via an inlet channel 13 through an inlet port 11 and the compressed gas escapes through an outlet port 12 connected to an outlet channel 14.

The compressor is of the oil injection type, in which oil for cooling, lubrication and sealing purposes is injected through an oil injection port 15. In the outlet channel 14 there is provided an oil separator 16 in which the oil is separated from the compressed gas and recirculated to the working space 3 via a pressure oil conduit 18 and the injection port 15, and the oil-.free gas leaves the separator through a delivery channel 17.

A secondary oil circuit is provided for lubricating the bearings 9, 10 at each shaft journal 7, 8. In that circuit a circulation pump 20 pumps oil through a conduit 21 and branch conduits 22, 23 to the bearings 9, 10, from where the oil is drained to an oil tank 26 provided at the outlet end section 6, the end section itself forming a part of the tank. The drainage from the bearings 9 in the inlet end section 5 is accomplished through a withdrawal conduit 25 and from the bearings 10 in the outlet end section 6 directly through the interior of this section.

The clearance between the shaft journal 8 at the outlet end constitutes a leakage path 31 through which oil can leak from the high pressure end of the compressor into the outlet end section 6, i.e. into the oil tank 26. And through a drainage connection 32 the tank 26 is in communication with the working space of the compressor, which connection ends in the working space where the pressure is lower than the compressor end pressure, preferably slightly above inlet pressure, which pressure thus will prevail in the oil tank 26. The same pressure will also prevail in the inlet end section 5.

The lubrication oil is sucked from the tank 26 by the circulation pump 20, which raises the pressure enough for delivering the oil to the bearings 9, 10 via a filter 29, conduit 21 and the branch conduits 22 and 23. Due to the relatively low pressure in the bearing lubrication circuit, the amount of working medium dissolved in the oil will be moderate and the lubrication ability of the oil will be sufficiently maintained.

Since oil from the oil injection circuit is allowed to leak from the high pressure end of the compressor working space along the shaft journal 8 into the outlet end section 6 enough oil will be present in the lubrication circuit. Any excess of oil in that circuit will flow through the drainage connection 32 back to the working space, where it is introduced at an early stage of the compression cycle.

In the arrangement described hereinabove, the bearing lubrication circuit and the oil injection circuit will operate at different pressure levels, making a relatively low pressure for the bearing lubrication oil possible. And a minor exchange of oil between the circuits takes place, through which the oil amount in the lubrication circuit is controlled in a simple and reliable way. The oil in the lubrication circuit has to be free from particles to a higher degree than the oil in the injection circuit, and is filtered through a high quality filter of fine mesh, whereas the filter 30 in the oil injection circuit can be of a more simple kind. The high quality filter 29 therefore can be dimensioned to take care of a relatively small amount of particles in comparence what would be required with a common system where all the oil would have to be highly filtered. Due to the lower pressure difference across this filter 29 in a system according to the invention, the requirement of the filter also in this respect will be smaller, allowing a cheaper filter to be used.

In the illustrated embodiment the bearing lubrication circuit is used also for supplying oil to the shaft sealing 33 of the driving shaft, to which it is supplied through a branch conduit 24 and returned through conduit 35. The compressor is also provided with a thrust balancing piston 34, to which oil is supplied from the oil separator 16 through a pressure oil branch conduit 36, and the oil leakage across the piston 34 is drained through a drainage conduit 37 to the oil tank 26 of lubrication system.

We claim:

1. A rotary displacement compressor having an inlet channel for introducing low pressure gas, an outlet channel through which compressed gas escapes, and at least one rotor mounted in bearings and operating in a working space, said compressor comprising:

a liquid injection port for injecting liquid into said working space, a liquid separator provided in said outlet channel for separating liquid from the compressed gas;

a pressure liquid conduit connecting said liquid separator and said liquid injection port; and a bearing lubrication circuit including a tank, a pump, a supply conduit for supplying liquid from said pump to said bearings in which said rotor is mounted, a withdrawal conduit for withdrawing liquid from said bearings to said tank, and a pump inlet conduit for supplying liquid from said tank to said pump, wherein said bearing lubrication circuit further includes a leakage path connecting said tank to a first cavity in said working space and a drainage connection connecting said tank to a second cavity in said working space, said first cavity having a higher pressure than said second cavity.

2. The compressor according to claim 1, wherein said compressor is a screw compressor having two meshing screw rotors.

3. The compressor according to claim 2, wherein said first cavity is at a compressor end pressure and said second cavity is at a pressure slightly above an inlet pressure.

4. The compressor according to claim 3, wherein said leakage path comprises a clearance around a rotor shaft journal at a high pressure end of the compressor, and wherein said drainage connection communicates with said tank at a lower level than said leakage path.

5. The compressor according to claim 1, wherein said supply conduit in said lubrication circuit includes a first filter, and said pressure liquid conduit includes a second filter, said first filter being capable of separating smaller particles than said second filter.

6. The compressor according to claim 1, further comprising a unit connected to said supply conduit by a branch conduit, said unit being supplied with liquid at substantially a same pressure as the liquid supplied to said bearings in which said rotor is mounted.

7. The compressor according to claim 1, further comprising an additional unit connected to said pressure liquid conduit by a pressure liquid branch conduit, and connected to said tank by a liquid drainage conduit, said additional unit being supplied with liquid at a higher pressure than the liquid supplied to said bearings in which said rotor is mounted.

8. The compressor according to claim 2, wherein said supply conduit in said lubrication circuit includes a first filter, and said pressure liquid conduit includes a second filter, said first filter being capable of separating smaller particles than said second filter.

9. The compressor according to claim 3, wherein said supply conduit in said lubrication circuit includes a first filter, and said pressure liquid conduit includes a second filter, said first filter being capable of separating smaller particles than said second filter.

10. The compressor according to claim 4, wherein said supply conduit in said lubrication circuit includes a first filter, and said pressure liquid conduit includes a second filter, said first filter being capable of separating smaller particles than said second filter.

11. The compressor according to claim 2, further comprising a unit connected to said supply conduit by a branch conduit, said unit being supplied with liquid at substantially a same pressure as the liquid supplied to said bearings in which said rotor is mounted.

12. The compressor according to claim 3, further comprising a unit connected to said supply conduit by a branch conduit, said unit being supplied with liquid at substantially a same pressure as the liquid supplied to said bearings in which said rotor is mounted.

13. The compressor according to claim 4, further comprising a unit connected to said supply conduit by a branch conduit, said unit being supplied with liquid at substantially a same pressure as the liquid supplied to said bearings in which said rotor is mounted.

14. The compressor according to claim 2, further comprising an additional unit connected to said pressure liquid conduit by a pressure liquid branch conduit, and connected to said tank by a liquid drainage conduit, said additional unit being supplied with liquid at a higher pressure than the liquid supplied to said bearings in which said rotor is mounted.

15. The compressor according to claim 3, further comprising an additional unit connected to said pressure liquid conduit by a pressure liquid branch conduit, and connected to said tank by a liquid drainage conduit, said additional unit being supplied with liquid at a higher pressure than the liquid supplied to said bearings in which said rotor is mounted.

16. The compressor according to claim 4, further comprising an additional unit connected to said pressure liquid conduit by a pressure liquid branch conduit, and connected to said tank by a liquid drainage conduit, said additional unit being supplied with liquid at a higher pressure than the liquid supplied to said bearings in which said rotor is mounted.

17. The compressor according to claim 6, wherein said unit comprises a shaft sealing of a driving shaft of said rotor.

18. The compressor according to claim 13, wherein said unit comprises a shaft sealing of a driving shaft of said rotor.

19. The compressor according to claim 7, wherein said additional unit comprises a thrust balancing piston.

20. The compressor according to claim 16, wherein said additional unit comprises a thrust balancing piston.

* * * * *